US008277232B2

(12) United States Patent
Herring et al.

(10) Patent No.: US 8,277,232 B2
(45) Date of Patent: Oct. 2, 2012

(54) STRADDLE MOUNT CONNECTOR

(75) Inventors: Michael David Herring, Apex, NC (US); Michael Allen Blanchfield, Camp Hill, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 49 days.

(21) Appl. No.: 12/900,306

(22) Filed: Oct. 7, 2010

(65) Prior Publication Data

US 2012/0088379 A1 Apr. 12, 2012

(51) Int. Cl.
*H01R 9/09* (2006.01)

(52) U.S. Cl. ..... 439/79

(58) Field of Classification Search ..... 439/79, 439/381

See application file for complete search history.

(56) References Cited

U.S. PATENT DOCUMENTS

| | | | | |
|---|---|---|---|---|
| 4,303,291 | A | 12/1981 | Dines | |
| 5,080,596 | A * | 1/1992 | Viselli et al. | 439/79 |
| 5,186,633 | A * | 2/1993 | Mosser, III | 439/79 |
| 5,433,624 | A * | 7/1995 | Tabata | 439/381 |
| 5,472,349 | A | 12/1995 | Dixon et al. | |
| 5,688,129 | A * | 11/1997 | Flaherty | 439/79 |
| 6,077,072 | A * | 6/2000 | Marin et al. | 432/105 |
| 6,210,180 | B1 * | 4/2001 | Lee et al. | 439/79 |
| 6,767,224 | B2 * | 7/2004 | Wu | 439/79 |
| 7,175,447 | B2 * | 2/2007 | Pan | 439/79 |
| 7,553,163 | B2 | 6/2009 | McAlonis et al. | |

* cited by examiner

*Primary Examiner* — Gary F. Paumen

(57) ABSTRACT

A straddle mount connector includes a housing that has a mating end and a mounting end configured to be mounted to an edge of a circuit board. Contacts are held by the housing with the contacts extending from the mounting end that are configured to be terminated to the circuit board. The contacts are arranged at the mating end and are configured for mating with a corresponding mating component. A comb extends from the mounting end of the housing that has a plurality of fingers separated from one another by a gap. The comb is positioned such that the fingers are positioned between corresponding contacts and the contacts are positioned within corresponding gaps.

24 Claims, 5 Drawing Sheets

STRADDLE MOUNT CONNECTOR

BACKGROUND OF THE INVENTION

The subject matter herein relates generally to circuit board connectors, and more particularly to straddle mount connectors that are mounted to an edge of a circuit board.

One type of electrical connector used in today's electronic equipment is termed a "straddle mount connector" or "board edge connector". The electrical connector is provided for receiving a circuit board having a mating edge and a plurality of contact pads or conductors exposed adjacent the mating edge of the board. Typically, the electrical connector includes contacts having cantilevered spring arms which are biased against the contact pads on the circuit board. The contacts are soldered to the contact pads after the electrical connector is mounted to the circuit board. In some applications, the electrical connector and the attached circuit board form a subassembly for a further device. One such use for the electrical connector is in the assembly of making memory cards or other electronic devices.

Known electrical connectors are not without disadvantages. For instance, there is a trend to decrease the contact spacing, or pitch, between the contacts and contact pads in order to increase the density of the electrical connector and reduce the amount of space the electrical connector requires on the circuit board. As the space between contacts decreases, there is an increased risk of bridging between adjacent contact pads on the circuit board on which the electrical connector is mounted. For example, as the electrical connector is mounted to the mating edge of the circuit board, the contacts plow through solder paste on the contact pads which causes the solder paste to spill over outside of the footprint of the contact pad. If the pitch is small enough, the solder paste of adjacent contact pads may become electrically connected creating an electrical short therebetween.

BRIEF DESCRIPTION OF THE INVENTION

In one embodiment, a straddle mount connector is provided having a housing that has a mating end and a mounting end configured to be mounted to an edge of a circuit board. Contacts are held by the housing with the contacts extending from the mounting end that are configured to be terminated to the circuit board. The contacts are arranged at the mating end and are configured for mating with a corresponding mating component. A comb extends from the mounting end of the housing that has a plurality of fingers separated from one another by a gap. The comb is positioned such that the fingers are positioned between corresponding contacts and the contacts are positioned within corresponding gaps.

In a further embodiment, a straddle mount connector is provided that includes a housing having a mating end and a mounting end configured to be mounted to an edge of a circuit board. Contacts are held by the housing with the contacts extending from the mounting end that are configured to be terminated to the circuit board. The contacts are arranged at the mating end and are configured for mating with a corresponding mating component. A comb extends from the mounting end of the housing that is removable from the housing. The comb has a plurality of fingers separated from one another by a gap. The comb is positioned such that the fingers are positioned between corresponding contacts and the contacts are positioned within corresponding gaps.

In another embodiment, a connector system is provided having a circuit board that has pads at an edge of the circuit board with solder paste thereon. A straddle mount connector is mounted to the edge of the circuit board. The straddle mount connector has a housing that has a mating end and a mounting end opposite the mating end. The mounting end is mounted to the edge of the circuit board. Contacts are held by the housing that extend from the mounting end and that engage the solder paste and are soldered to corresponding pads of the circuit board. The contacts are arranged at the mating end and are configured for mating with a corresponding mating component. A comb extends from the mounting end of the housing that has a plurality of fingers separated from one another by a gap. The comb is positioned such that the fingers are positioned between corresponding contacts and the contacts are positioned, within corresponding gaps.

DETAILED DESCRIPTION OF THE INVENTION

Figure 1:
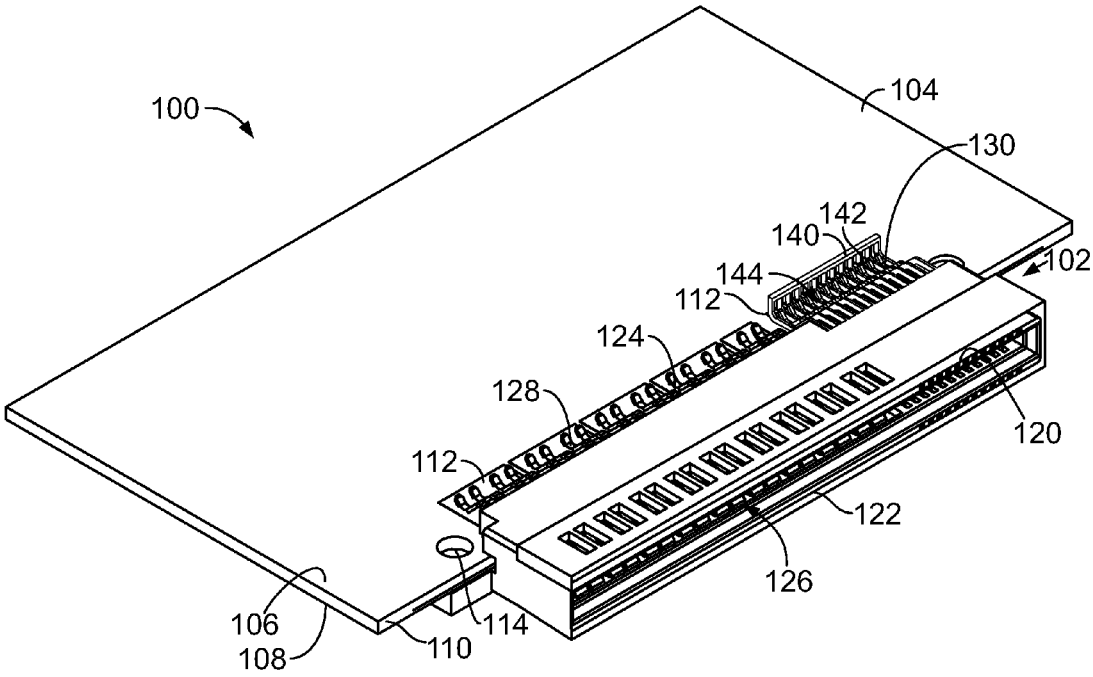
FIG. 1 illustrates a connector system formed in accordance with an exemplary embodiment showing a straddle mount connector mounted to a circuit board.

FIG. 1 illustrates a connector system 100 formed in accordance with an exemplary embodiment. The connector system 100 includes a straddle mount connector 102 mounted to a circuit board 104. Electrical components (not shown), such as memory modules, processors and the like may also be mounted to the circuit board 104. Optionally, more than one straddle mount connector 102 may be mounted to the circuit board 104.

The circuit board 104 includes a first surface 106 and a second surface 108. The circuit board 104 has a mating edge 110 with a plurality of contact pads 112 on the first and second surfaces 106, 108 at the mating edge 110. The straddle mount connector 102 is mounted to the circuit board 104 at the mating edge 110 such that the straddle mount connector 102 is electrically connected to the contacts pad 112. The contact pads 112 may be any type of pads, such as power pads, signal pads, ground pads and the like, where power is transmitted through the power pads, data signals are transmitted through the signal pads, and the ground pads are electrically commoned with a ground plane of the circuit board 104.

The circuit board 104 includes mounting features 114 for securely coupling the straddle mount connector 102 to the circuit board 104. In the illustrated embodiment, the mounting features 114 constitute openings through the circuit board 104. A fastener or other component may be received in the opening to secure the straddle mount connector 102 to the circuit board 104.

The straddle mount connector 102 includes a housing 120 having a mating end 122 and a mounting end 124 opposite the mating end 122. The mating end 122 is configured for mating with a corresponding mating component. In the illustrated embodiment, the mating end 122 includes a slot 126 that is configured to receive a circuit card therein. The circuit card represents the mating component. The circuit card may include contact pads proximate to an edge of the circuit card, where the edge is received in the slot 126. Other types of mating components may be used in alternative embodiments, such as a mating connector.

The straddle mount connector 102 includes a plurality of power contacts 128 and a plurality of signal contacts 130. The straddle mount connector 102 may include other types of contacts in alternative embodiments, such as ground contacts. The straddle mount connector 102 may include only power contacts 128 or only signal contacts 130 in alternative embodiments. The power contacts 128 and signal contacts 130 are held by the housing 120. The power contacts 128 and the signal contacts 130 extend from the mounting end 124 of the housing 120 for terminating to the contact pads 112 on the circuit board 104. The mounting ends of the power contacts 128 and signal contacts 130 extend from the mounting end 124 and are cantilevered beyond the mounting end 124. In an exemplary embodiment, the power contacts 128 and the signal contacts 130 are soldered to the contact pads 112 to electrically and mechanically couple the power contacts 128 and signal contacts 130 to the contact pads 112.

The power contacts 128 and signal contacts 130 extend through the housing 120 and are arranged at the mating end 122 of the housing 120 for mating with the mating component. For example, ends of the power contacts 128 and signal contacts 130 are exposed within the slot 126 for mating with the circuit card when the circuit card is plugged into the slot 126. The housing 120 surrounds the power contacts 128 and the signal contacts 130 at mating ends thereof.

In an exemplary embodiment, the power contacts 128 and signal contacts 130 are arranged in both an upper row and a lower row within the housing 120 such that the power contacts 128 and the signal contacts 130 may engage contact pads 112 on both the first surface 106 and the second surface 108. The power contacts 128 and the signal contacts 130 are also configured to engage contact pads on both an upper surface and a lower surface of the circuit card that is plugged into the slot 126. The power contacts 128 and signal contacts 130 are arranged along both an upper portion and a lower portion of the slot 126 and define a space therebetween that receives the circuit card between the upper and lower rows of the power contacts 128 and signal contacts 130.

The straddle mount connector 102 includes a comb 140 extending from the mounting end 124 of the housing 120. The comb 140 is arranged adjacent to and interspersed between the signal contacts 130. The comb 140 includes a plurality of fingers 142 separated from one another by gaps 144. The comb 140 is positioned with respect to the signal contacts 130 such that the fingers 142 are positioned between corresponding signal contacts 130 and the signal contacts 130 are positioned within corresponding gaps 144. The fingers 142 electrically separate the signal contacts 130 from one another. The fingers 142 prevent bridging of solder paste on the contact pads 112 between adjacent contact pads 112. In the illustrated embodiment, the comb 140 is integrally formed with the housing 120. Optionally, the comb 140 may be removable from the housing 120. The comb 140 may be removable from the housing 120 by breaking the comb 140 off from the housing 120. Alternatively, the comb 140 may be a separate and discrete component from the housing 120 and may be coupled to the housing 120 during mounting of the straddle mount connector 102 to the circuit board 104. The comb 140 may be removed from the housing 120 after the straddle mount connector 102 is coupled to the circuit board 104.

Figure 2:
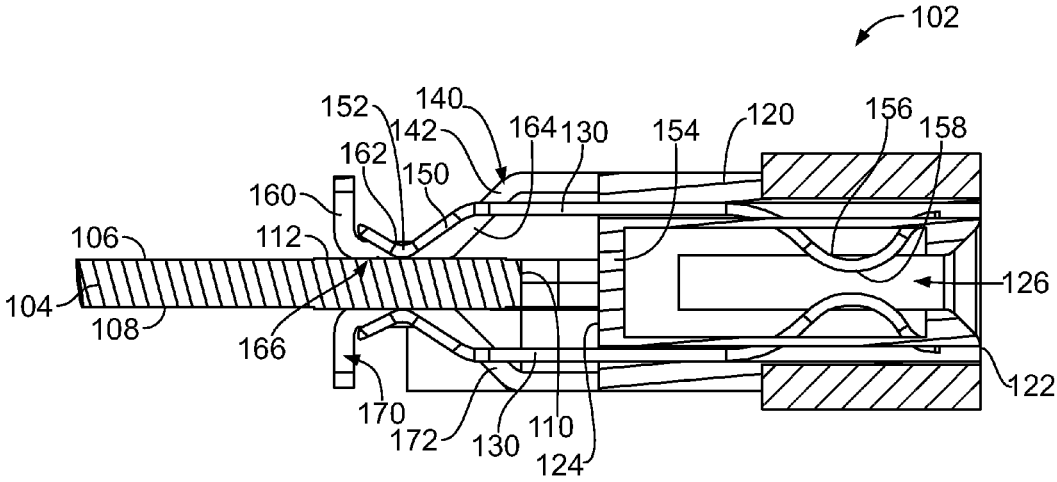
FIG. 2 is a side view of the straddle mount connector mounted to the circuit board.

FIG. 2 is a cross-sectional view of the straddle mount connector 102 mounted to the circuit board 104. The mounting end 124 of the housing 120 abuts against the mating edge 110 of the circuit board 104. The signal contacts 130 extend from the mounting end 124 and engage the contact pads 112 on the first and second surfaces 106, 108 of the circuit board 104.

The signal contacts 130 have contact tails 150 that extend from the mounting end 124. The contact tails 150 are cantilevered from the housing 120. The contact tails 150 have a mating interface 152 defined proximate to the distal end of the contact tails 150. The mating interface 152 is the portion of the contact tail 150 that engages the contact pad 112 on the circuit board 104. Optionally, the contact tails 150 may be curved proximate to the distal ends of the contact tails 150 to define the mating interfaces 152. The contact tails 150 constitute spring beams that extend from the housing 120, which are spring biased against the circuit board 104. In an exemplary embodiment, when the straddle mount connector 102 is mounted to the circuit board 104, the contact tails 150 are deflected outward, which causes the contact tails 150 to be spring biased toward the circuit board 104. The spring force of the contact tails 150 forces the mating interfaces 152 to maintain contact with the contact pads 112.

The signal contacts 130 extend through the housing 120 and are exposed within the slot 126. The housing 120 includes a wall 154 at the mounting end 124. The signal contacts 130 extend through openings in the wall 154. The signal contacts 130 have contact beams 156 extending forward from the wall 154 of the housing 120. The contact beams 156 are exposed within the slot 126. The contact beams 156 include mating interfaces 158 proximate to distal ends of the contact beams 156. The mating interfaces 158 are configured to engage the pads on the circuit card when the circuit card is loaded into the slot 126. Optionally, the contact beams 156 may be curved proximate to the distal ends thereof to define a convex shape at the mating interface 158. The contact beams 156 may be at least partially deflected within the slot 126 when the circuit card is loaded into the slot 126. Such deflection causes the contact beams 156 to be spring biased against the circuit card.

The comb 140 extends from the mounting end 124 of the housing 120 proximate to the signal contacts 130 in the upper row. The fingers 142 include a plow 160 at a distal end thereof. A rail 162 extends forward from the plow 160 and a transition section 164 extends between the rail 162 and the mounting end 124 of the housing 120.

In the illustrated embodiment, the plow 160 is oriented generally parallel to the mounting end 124. The plow 160 may extend generally vertically. The plow 160 is positioned rearward of the distal end of the contact tails 150. The plow 160 is positioned a further distance from the mounting end 124 than the distal end of the contact tails 150.

In an exemplary embodiment, the rail 162 is oriented generally parallel to the circuit board 104. The rail 162 may be oriented perpendicular with respect to the plow 160. The rail 162 may be oriented perpendicular with respect to the mounting end 124. The rail 162 includes a resting surface 166 that engages and rests on the first surface 106 of the circuit board 104. The resting surface 166 may be generally flat to maintain engagement with the first surface 106. The rails 162 are aligned with the mating interfaces 152 a distance from the mounting end 124 of the housing 120. The resting surfaces 166 engage the circuit board 104 between the mating interfaces 152. Optionally, the rail 162 may be biased against the circuit board 104. For example, when the straddle mount connector 102 is mounted to the circuit board 104, the circuit board 104 may deflect the fingers 142 outward causing the rail 162 to be compressed against the first surface 106. The resting surfaces 166 are substantially coplanar with the mating interfaces 152 for engaging the circuit board 104.

The transition section 164 extends between the rail 162 and the mounting end 124. Optionally, the transition section 164 may be angled at an acute angle with respect to the rail 162. The transition section 164 may include one or more curved or angled section such that the transition section 164 is non-linear.

The straddle mount connector 102 includes a comb 170 at the lower end of the housing 120. The comb 170 may be substantially similar to the comb 140. The comb 170 includes fingers 172 that extend between the signal contacts 130 in the lower row. The fingers 172 are configured to engage the second surface 108 of the circuit board 104.

Figure 3:
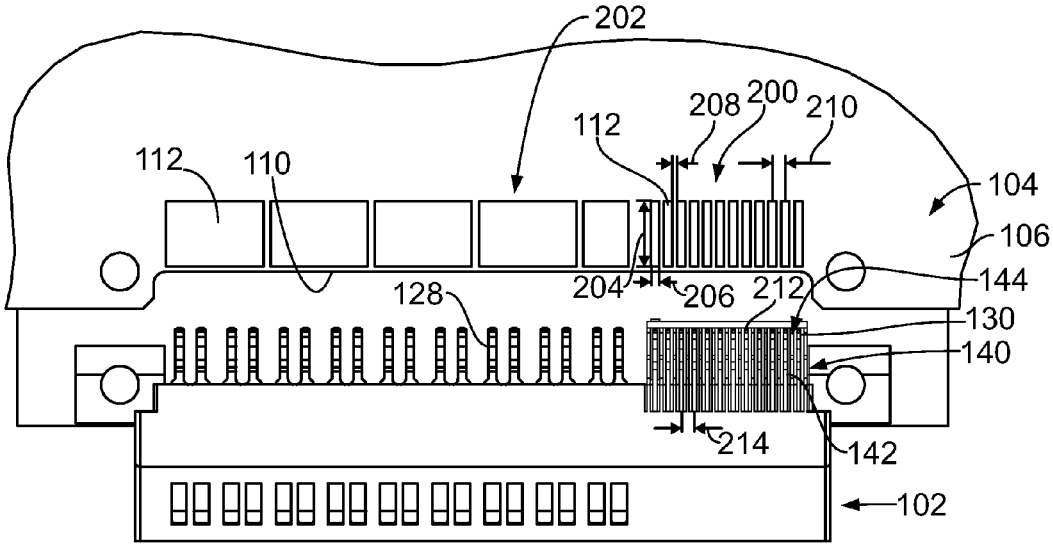
FIG. 3 is a top view of the straddle mount connector and the circuit board with the straddle mount connector poised for mounting to the circuit board.

FIG. 3 is a top view of the straddle mount connector 102 poised for mounting to the circuit board 104. The contact pads 112 are arranged along the first surface 106 at the mating edge 110. The contact pads 112 configured for mating with the signal contacts 130 are arranged in a group 200 that defines signal contact pads. The contact pads 112 configured for mating with the power contacts 128 are arranged in a group 202 that define power contact pads. The power contact pads are larger than the signal contact pads. The power contact pads are configured for mating with multiple power contacts 128, whereas the signal contact pads are configured for mating with single signal contacts 130.

The signal contact pads have a length 204, a width 206 and a spacing 208 between the contact pads 112. The signal contact pads have a predetermined pitch 210 between adjacent signal contact pads. The pitch 210 is relatively small allowing a large number of signal contact pads to be arranged along a given width of the mating edge 110. The spacing 208 is relatively small to provide the small pitch 210. In the illustrated embodiment, the spacing 208 is narrower than the width 206 of each of the signal contact pads.

The narrow spacing 208 would not be possible without consideration for the possibility of solder paste seepage from the contact pads 112. Solder paste seepage from the contact pads 112 may cause bridging between adjacent signal contact pads. Solder paste seepage may occur when the signal contacts 130 plow through the solder paste on the contact pads 112 during mating of the straddle mount connector 102 to the circuit board 104. The comb 140 is used to prevent solder paste seepage from bridging between the different circuits. The fingers 142 operate as barriers between adjacent contact pads 112. The fingers 142 operate as barriers between adjacent signal contacts 130. The fingers 142 block the solder paste from bridging. The fingers 142 block molten solder from seeping across the space between adjacent contact pads 112. The fingers 142 displace solder paste that is located between the contact pads 112. For example, during assembly, the fingers plow through solder paste that is between the contact pads 112. The comb 140 allows the narrow spacing 208 between the adjacent contact pads 112 by preventing the risk of solder paste bridging.

The comb 140 includes a bridge 212 at the distal ends of the fingers 142. The bridge 212 attaches each of the fingers 142 together. The bridge 212 maintains the spacing of the gaps 144.

The fingers 142 have a thickness 214 measured between opposite sides of the fingers 142. In an exemplary embodiment, the thickness 214 is less than the spacing 208. As such, the fingers 142 fit between the contact pads 112.

Figure 4:
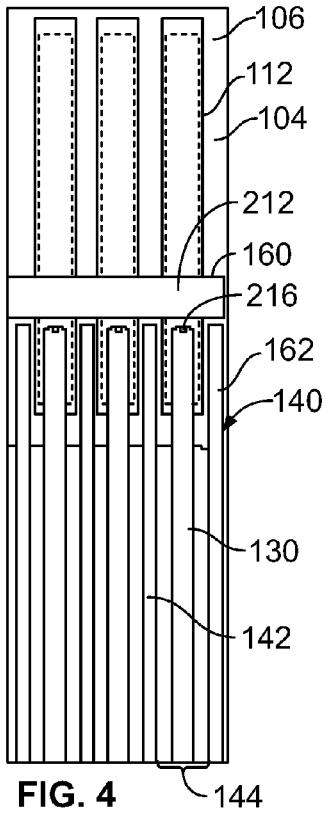
FIG. 4 is an enlarged view of a portion of the straddle mount connector and circuit board during an initial mating step.
Figure 5:
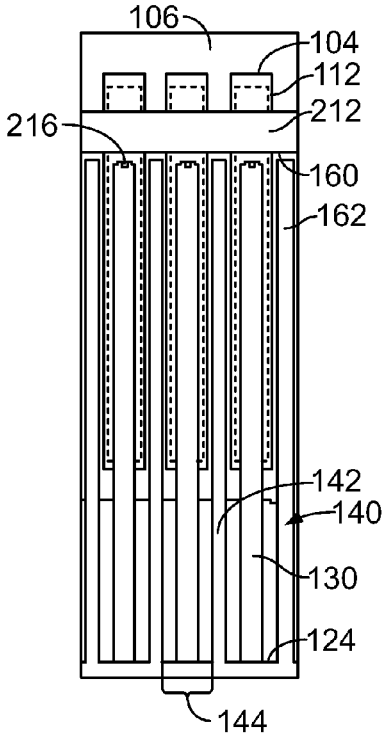
FIG. 5 is an enlarged view of a portion of the straddle mount connector and circuit board in a final mated position.

FIG. 4 is an enlarged view of a portion of the straddle mount connector 102 and the circuit board 104 showing the signal contacts 130 and comb 140 being mounted to the circuit board 104 during an initial mounting stage. FIG. 5 is an enlarged view of the straddle mount connector 102 and the circuit board 104 showing the signal contacts 130 and comb 140 mounted to the circuit board 104.

As shown in FIG. 4, the comb 140 leads the signal contacts 130 during mounting to the circuit board 104. The plow 160 (shown in FIG. 2) and the bridge 212 are positioned further from the mounting end 124 (shown in FIG. 5) than distal ends 216 of the signal contacts 130. The plow 160 and portions of the rails 162 are loaded onto the circuit board 104 prior to the signal contacts 130. The rails 162 are positioned between the contact pads 112 prior to the signal contacts 130 engaging the contact pads 112. As such, the fingers 142 are in position to block the solder paste from seeping across the space between the contact pads 112.

During assembly, as the signal contacts 130 are slid onto the contact pads 112, the solder paste on the contact pads 112 is at least partially displaced and pushed out of the way by the signal contacts 130. The fingers 142, and more particularly, the rails 162, block the solder paste from seeping across the space between the contact pads 112. The fingers 142 contain the solder paste within the gaps 144. None of the solder paste is allowed to seep over or under the fingers 142. For example, the rails 162 may be tall enough to prevent the solder paste from seeping over the top of the rails 162. The rails 162 are held against the first surface 106 such that the solder paste is prevented from seeping between the rails 162 and the first surface 106. As the straddle mount connector 102 is continued to be loaded onto the circuit board 104, the signal contacts 130 slide along the contact pads 112. All of the displaced solder paste is blocked by the fingers 142. Once the straddle mount connector 102 is mounted to the circuit board 104, the signal contacts 130 may be soldered to the contact pads 112, such as during a soldering process.

Figure 6:
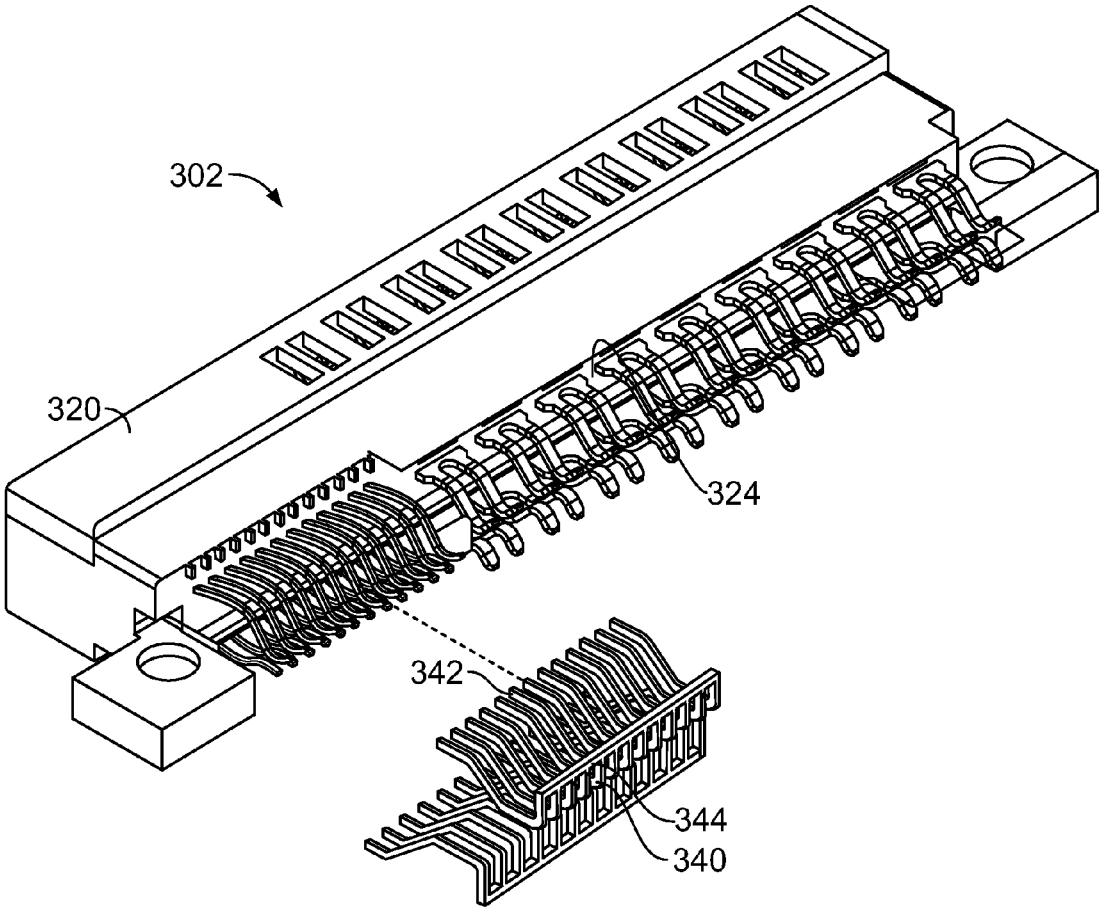
FIG. 6 is a top perspective view of an alternative straddle mount connector mounted to the circuit board.

FIG. 6 is a perspective view of an alternative straddle mount connector 302 that may be mounted to the circuit board 104 (shown in FIG. 1). The straddle mount connector 302 is similar to the straddle mount connector 102 (shown in FIG. 1), however the straddle mount connector 302 includes a removable comb 340. The straddle mount connector 302 includes a housing 320 having a mounting end 324. The comb 340 extends from the mounting end 324 and is removable from the housing 320. In the illustrated embodiment, the comb 340 is removable from the housing 320 by breaking the comb 340 from the housing 320.

The comb 340 includes fingers 342 cantilevered from the mounting end 324. The comb 340 is integrally formed with the housing 320, such as during a common molding process. The comb 340 may be broken away from housing 320 by lifting or pulling a bridge 344 of the comb 340 at the distal end of the fingers 342. The bridge 344 acts as a finger grip for pulling the comb 340 off of the housing 320. The fingers 342 may snap off near the mounting end 324 of the housing 320.

The comb 340 may be removed after the straddle mount connector 302 is coupled to the circuit board 104. Optionally, the comb 340 may be removed after the straddle mount connector 302 is soldered to the circuit board 104. Alternatively, the comb 340 may be removed prior to the straddle mount connector 302 being soldered to the circuit board 104.

Figure 7:
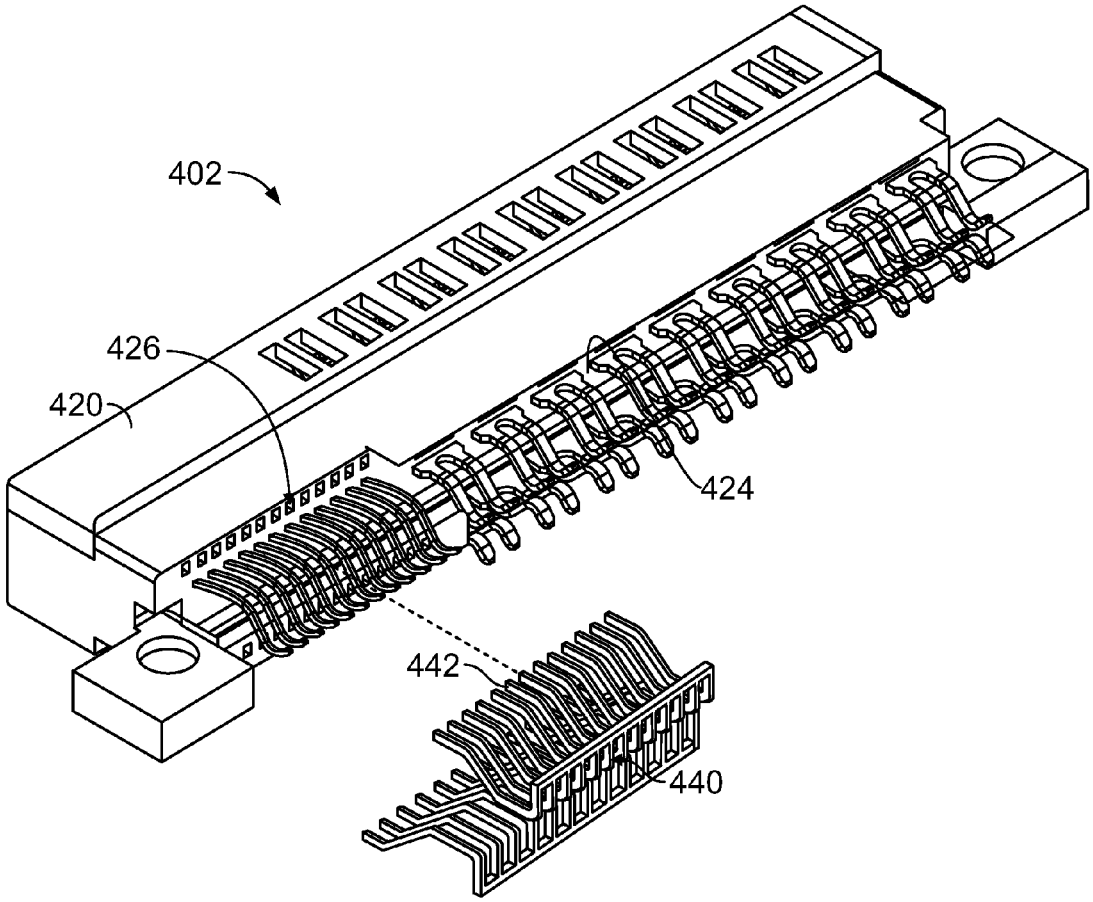
FIG. 7 is a top perspective view of another alternative straddle mount connector.

FIG. 7 is a perspective view of an alternative straddle mount connector 402 that is configured to be mounted to a circuit board 104 (shown in FIG. 1). The straddle mount connector 402 may be similar to the straddle mount connector 102 (shown in FIG. 1), however the straddle mount connector 402 may include a comb 440 that is separate and distinct from a housing 420. The comb 440 may be removably coupled to the housing 420.

The housing 420 includes a mounting end 424 having a plurality of openings 426 in the mounting end 424. The comb 440 includes fingers 442. The comb 440 is coupled to the housing 420 by loading the fingers 442 into the openings 426 in the mounting end 424. The fingers 442 may be held in the openings 426 by an interference fit. Once the straddle mount connector 402 is mounted to the circuit board 104, the comb 440 may be removed from the housing 420 by pulling the comb 440 away from the housing 420. The fingers 442 are pulled out the openings 426 and the comb 440 may then be removed from housing 420.

Figure 8:
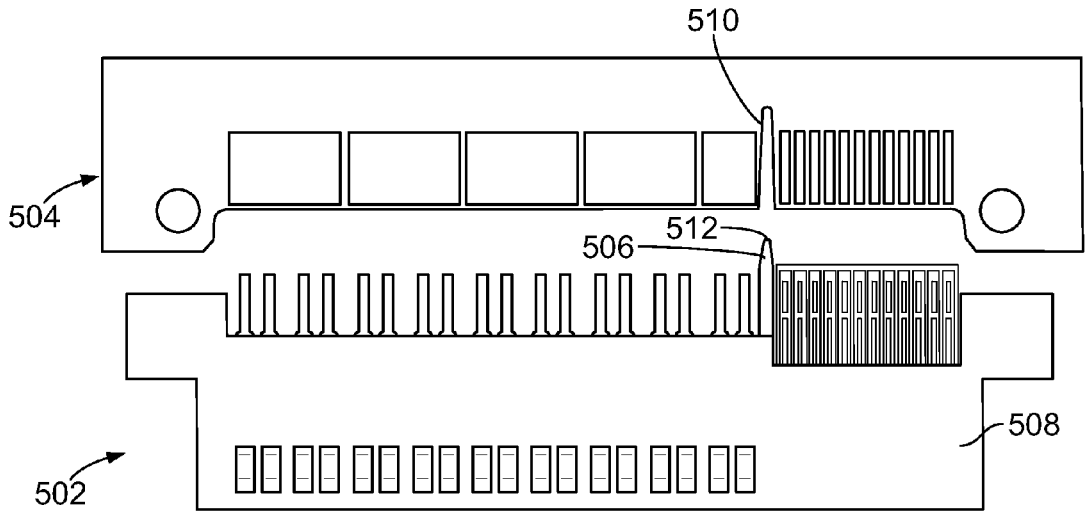
FIG. 8 is a top view of another alternative straddle mount connector poised for mounting to an alternative circuit board.

FIG. 8 is a top view of another alternative straddle mount connector 502 poised for mounting to an alternative circuit board 504. The straddle mount connector 502 may be similar to the straddle mount connector 102 (shown in FIG. 1), however the straddle mount connector 502 includes an alignment feature 506 extending from a housing 508 of the straddle mount connector 502. The circuit board 504 may be similar to the circuit board 104 (shown in FIG. 1), however the circuit board 504 includes an alignment feature 510 therein.

The alignment feature 506 of the straddle mount connector 502 constitutes a tab or finger projecting forward from the housing 508. A distal end 512 of the alignment feature 506 may be chamfered to orient the alignment feature 506 with the alignment feature 510.

The alignment feature 510 of the circuit board 504 constitutes a slot formed in the front edge of the circuit board 504. The slot may be chamfered at the front edge to guide the alignment feature 506 of the straddle mount connector 502 into the alignment feature 510.

Figure 9:
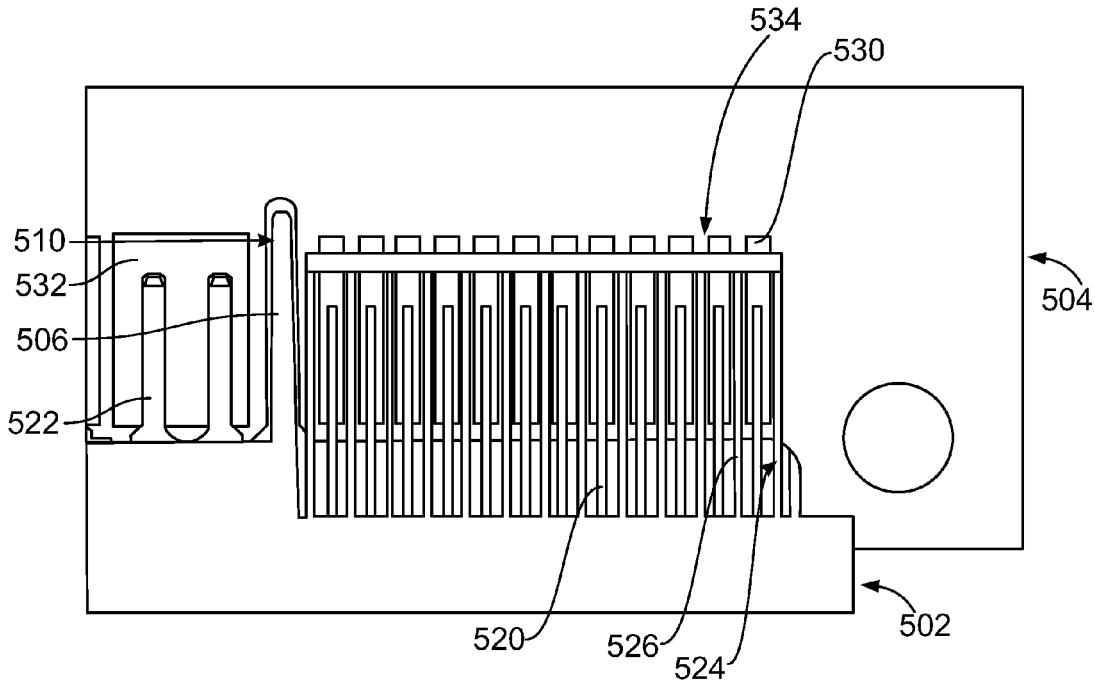
FIG. 9 is a top view of a portion of the straddle mount connector and circuit board shown in FIG. 8 in an assembled state.

FIG. 9 is a top view of a portion of the straddle mount connector 502 and circuit board 504 in an assembled state. The alignment feature 506 is received in the alignment feature 510. The alignment features 506, 510 cooperate to align the straddle mount connector 502 with respect to the circuit board 504.

The straddle mount connector 502 includes signal contacts 520 and power contacts 522. The straddle mount connector includes a comb 524 with fingers 526 between the signal contacts 520. The alignment feature 506 extends further from the housing 508 than the comb 524 and the signal contacts 520 such that the alignment feature 506 mates with the circuit board 504 prior to the comb 524 or signal contacts 520. The circuit board 504 includes signal pads 530 and power pads 532. The signal pads 530 are separated by gaps 534.

The alignment features 506, 510 cooperate to align the signal contacts 520 with the signal pads 530. The alignment features 506, 510 cooperate to align the power contacts 522 with the power pads 532. The alignment features 506, 510 cooperate to align the fingers 526 with the gaps 534 such that the fingers 526 are positioned between the signal pads 522. The alignment features 506, 510 reduce the tolerances needed to ensure alignment of the straddle mount connector 502 with the circuit board 504, allowing the signal contacts 520 and signal pads 530 to have a tighter spacing or pitch.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. A straddle mount connector comprising:

a housing having a mating end and a mounting end configured to be mounted to an edge of a circuit board;

contacts held by the housing, the contacts extending from the mounting end and being configured to be terminated to the circuit board, the contacts being arranged at the mating end and being configured for mating with a corresponding mating component; and a comb extending from the mounting end of the housing, the comb having a plurality of fingers separated from one another by a gap, the comb being positioned such that the fingers are positioned between corresponding contacts and the contacts are positioned within corresponding gaps, wherein the fingers each include a flat rail configured to engage the circuit board, the rail being biased against the circuit board.

2. The straddle mount connector of claim 1, wherein the comb is fabricated from a dielectric material and blocks electrical shorting between circuits defined by the contacts.

3. The straddle mount connector of claim 1, wherein the fingers block solder paste bridging between the contacts.

4. The straddle mount connector of claim 1, wherein the comb is cantilevered from the mounting end of the housing.

5. The straddle mount connector of claim 1, wherein the comb includes a bridge at distal ends of the fingers, the bridge attaching the fingers together.

6. The straddle mount connector of claim 1, wherein the contacts include mating interfaces configured to engage pads on the circuit board, the rails having resting surfaces, the rails being aligned with the mating interfaces a distance from the mounting end of the housing, the resting surfaces being substantially coplanar with the mating interfaces for engaging the circuit board.

7. The straddle mount connector of claim 1, wherein the contacts are arranged in an upper row and a lower row, the upper row of contacts engaging an upper surface of the circuit board, the lower row of contacts engaging a lower surface of the circuit board, the comb comprising an upper comb, the straddle mount connector further comprising a lower comb, wherein the upper comb and the lower comb are configured to engage the upper surface and the lower surface respectively.

8. The straddle mount connector of claim 1, wherein the comb is removably coupled to the housing.

9. The straddle mount connector of claim 1, further comprising an alignment feature configured to engage a corresponding alignment feature of the circuit board to align the housing with the circuit board.

10. A straddle mount connector comprising:

a housing having a mating end and a mounting end configured to be mounted to an edge of a circuit board;

contacts held by the housing, the contacts extending from the mounting end and being configured to be terminated to the circuit board, the contacts being arranged at the mating end and being configured for mating with a corresponding mating component; and a comb extending from the mounting end of the housing, the comb being removable from the housing, the comb having a plurality of fingers separated from one another by a gap, the comb including a bridge at distal ends of the fingers, the bridge attaching the fingers together, the comb being positioned such that the fingers are positioned between corresponding contacts and the contacts are positioned within corresponding gaps.

11. The straddle mount connector of claim 10, wherein the comb is fabricated from a dielectric material and blocks electrical shorting between circuits defined by the contacts.

12. The straddle mount connector of claim 10, wherein the fingers block solder paste bridging between the contacts.

13. The straddle mount connector of claim 10, wherein the comb is separately provided from, and coupled to, the housing.

14. The straddle mount connector of claim 10, wherein the comb is integrally formed with the housing, the fingers being breakable from the housing to remove the comb from the housing.

15. The straddle mount connector of claim 10, wherein the fingers each include a flat rail configured to engage the circuit board, the rail being biased against the circuit board.

16. The straddle mount connector of claim 10, wherein the contacts include mating interfaces configured to engage pads on the circuit board, the fingers include rails having resting surfaces, the rails being aligned with the mating interfaces a distance from the mounting end of the housing, the resting surfaces being substantially coplanar with the mating interfaces for engaging the circuit board.

17. The straddle mount connector of claim 10, wherein the contacts are arranged in an upper row and a lower row, the upper row of contacts engaging an upper surface of the circuit board, the lower row of contacts engaging a lower surface of the circuit board, the comb comprising an upper comb, the straddle mount connector further comprising a lower comb, wherein the upper comb and the lower comb are configured to engage the upper surface and the lower surface respectively.

18. A connector system comprising:

a circuit board having pads at an edge of the circuit board, the pads having solder paste thereon; and a straddle mount connector mounted to the edge of the circuit board, the straddle mount connector comprising:

a housing having a mating end and a mounting end opposite the mating end, the mounting end being mounted to the edge of the circuit board;

contacts held by the housing, the contacts extending from the mounting end, the contacts engaging the solder paste and being soldered to corresponding pads of the circuit board, the contacts being arranged at the mating end and being configured for mating with a corresponding mating component; and a comb extending from the mounting end of the housing, the comb having a plurality of fingers separated from one another by a gap, the comb being positioned such that the fingers are positioned between corresponding contacts and the contacts are positioned within corresponding gaps;

wherein the housing is coupled to the circuit board by sliding the contacts along the pads, the fingers creating an electrical barrier between the solder paste of adjacent pads.

19. The connector system of claim 18, wherein the comb is fabricated from a dielectric material and blocks electrical shorting between circuits defined by the contacts.

20. The connector system of claim 18, wherein the fingers block solder paste bridging between the contacts.

21. The connector system of claim 18, wherein the circuit board comprises an alignment feature and the straddle mount connector comprises an alignment feature received in the alignment feature of the circuit board to align the straddle mount connector with the circuit board.

22. The connector system of claim 18, wherein the fingers each include a flat rail engaging the circuit board, the rail being biased against the circuit board.

23. The connector system of claim 18, wherein the contacts include mating interfaces engaging the pads on the circuit board, the fingers include rails having resting surfaces, the rails being aligned with the mating interfaces a distance from the mounting end of the housing, the resting surfaces being substantially coplanar with the mating interfaces for engaging the circuit board.

24. The connector system of claim 18, wherein the contacts are arranged in an upper row and a lower row, the upper row of contacts engaging an upper surface of the circuit board, the lower row of contacts engaging a lower surface of the circuit board, the comb comprising an upper comb, the straddle mount connector further comprising a lower comb, wherein the upper comb and the lower comb are configured to engage the upper surface and the lower surface respectively.

* * * * *